US006192544B1

(12) United States Patent
Persidsky et al.

(10) Patent No.: US 6,192,544 B1
(45) Date of Patent: Feb. 27, 2001

(54) TOOTHBRUSH WITH PROTECTIVE BUMPER, AND METHOD

(76) Inventors: Maxim D. Persidsky, 35 Temescal Ter., San Francisco, CA (US) 94118; Don LeRoy Thatcher, 2908 Capitola Ct., Fairfield, CA (US) 94533

( * ) Notice: Subject to any disclaimer, the term of this patent is extended or adjusted under 35 U.S.C. 154(b) by 0 days.

(21) Appl. No.: 09/046,968

(22) Filed: Mar. 24, 1998

Related U.S. Application Data

(63) Continuation-in-part of application No. 08/748,809, filed on Nov. 15, 1996, now abandoned.

(51) Int. Cl.[7] ..... A46B 9/04
(52) U.S. Cl. ..... 15/167.1; 15/246
(58) Field of Search ..... 15/110, 167.1, 15/167.2, 246

(56) References Cited

U.S. PATENT DOCUMENTS

| | | | | |
|---|---|---|---|---|
| 817,117 | * | 4/1906 | Isaacs | 15/246 |
| 941,306 | * | 11/1909 | Burnside | 15/246 |
| 1,188,823 | * | 6/1916 | Plank | 15/110 |
| 1,251,250 | * | 12/1917 | Libby | 15/110 |
| 1,532,522 | * | 4/1925 | Weaver, Jr. | 15/110 |
| 2,144,408 | * | 1/1939 | Holmes . | |
| 2,253,210 | * | 8/1941 | Psiharis | 15/167.1 |
| 2,473,773 | * | 6/1949 | West . | |
| 3,258,805 | * | 7/1966 | Rossnan | 15/110 |
| 3,337,893 | * | 8/1967 | Fine . | |
| 4,628,564 | * | 12/1986 | Youssef | 15/167.1 |
| 5,325,560 | * | 7/1994 | Pavone | 15/167.1 |
| 5,373,602 | * | 12/1994 | Bang | 15/167.1 |

FOREIGN PATENT DOCUMENTS

2402785 * 7/1975 (DE) .

* cited by examiner

*Primary Examiner*—Randall E. Chin
(74) *Attorney, Agent, or Firm*—Flehr Hohbach Test Albritton & Herbert LLP

(57) ABSTRACT

Toothbrush having a peripheral cushioning bumper for preventing impact injury to the teeth and gums of a person using it. The bumper consists of a body of resilient material mounted in a peripheral groove in the side edge of the head of the brush. In some disclosed embodiments, the resilient body is a ring that passes through a tunnel at the base of the head, which prevents the ring from being dislodged and lost or swallowed. In one such embodiment, the head of the brush is formed in two sections, and the bumper is an O-ring which is placed in the groove before the two sections are joined together. In another, the ring is molded in place on the brush.

19 Claims, 3 Drawing Sheets

Fig. 1
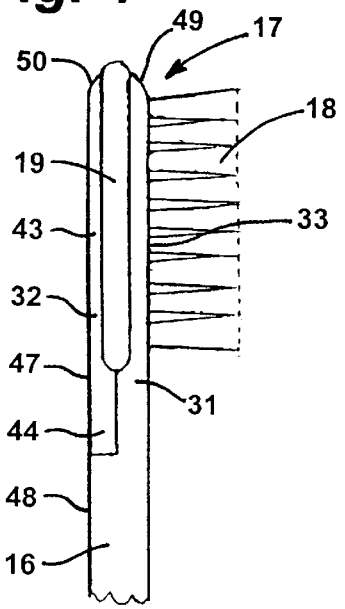
Fig. 2
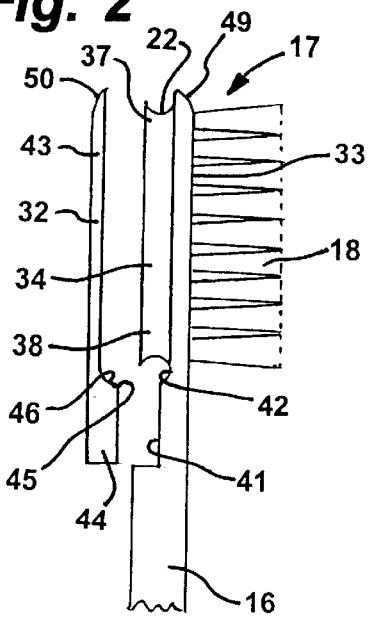
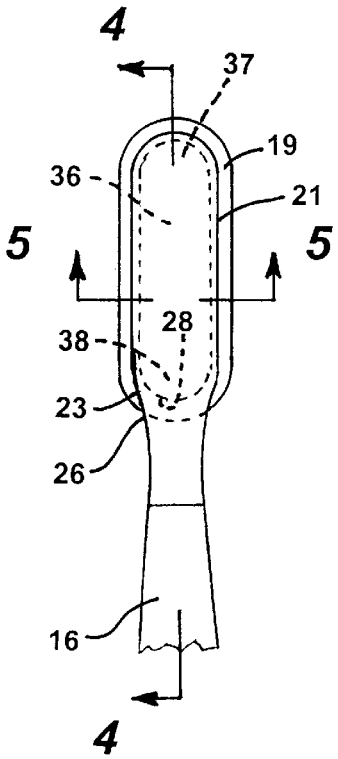
Fig. 3
Fig. 4
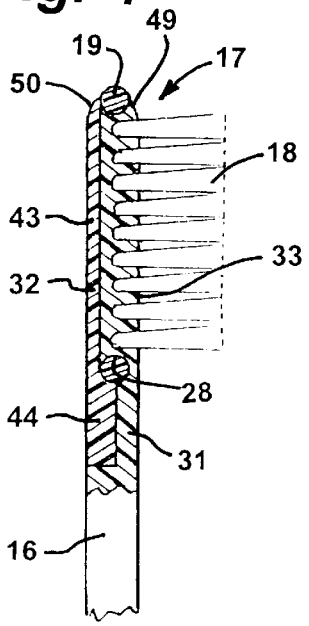
Fig. 5
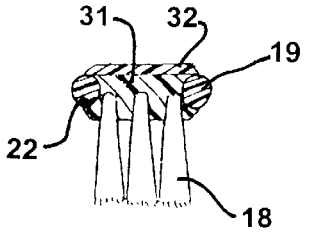

Fig. 6
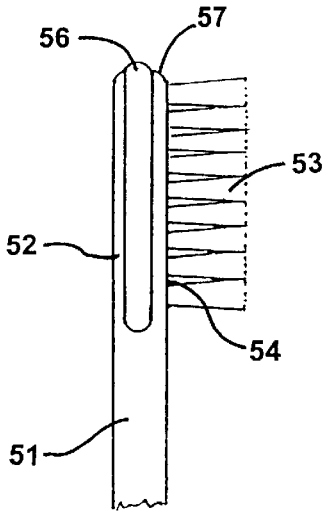
Fig. 7
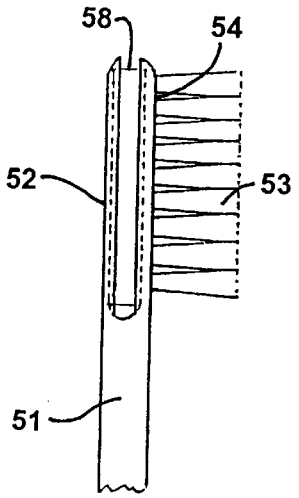
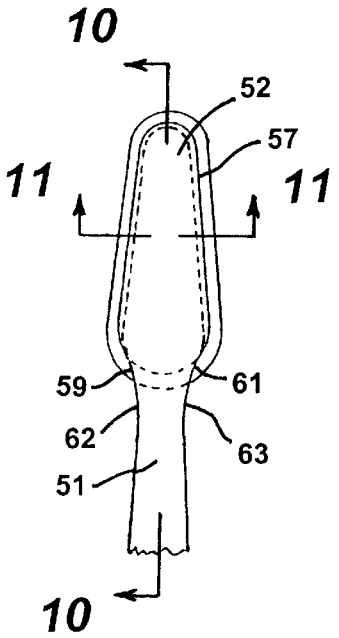
Fig. 9
Fig. 8
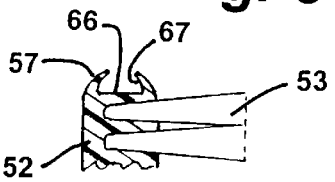
Fig. 10
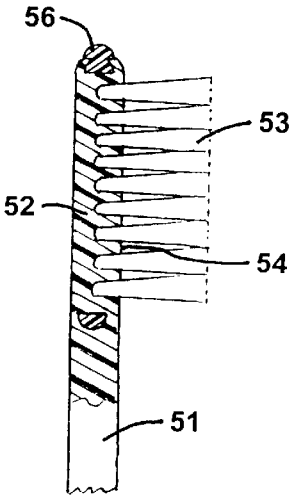
Fig. 11
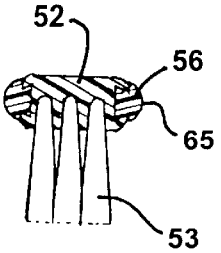

Fig. 12
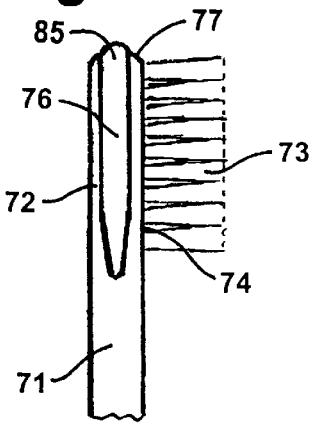
Fig. 13
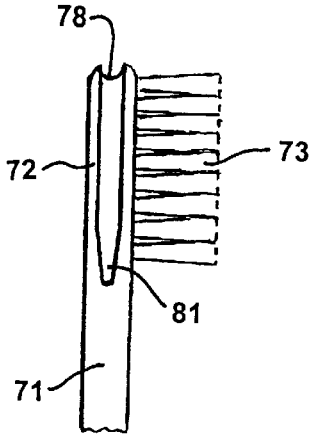
Fig. 15
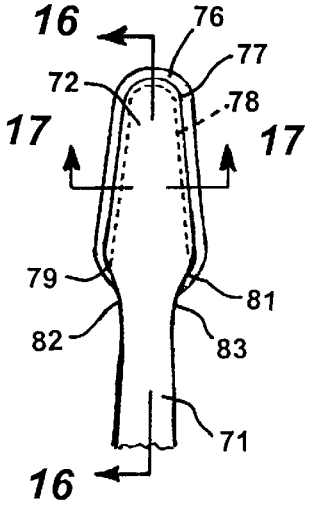
Fig. 16
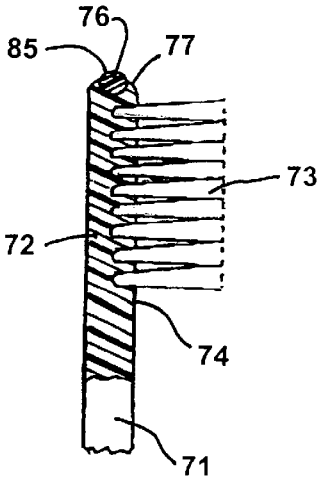
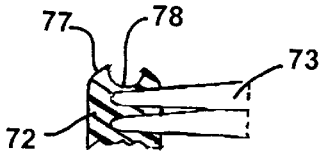
Fig. 14
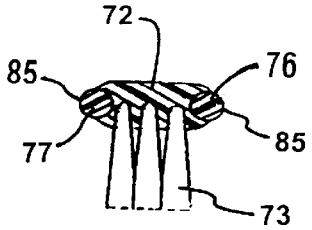
Fig. 17

TOOTHBRUSH WITH PROTECTIVE BUMPER, AND METHOD

CROSS-REFERENCE TO RELATED APPLICATION

This is a continuation-in-part of Ser. No. 08/748,809, filed Nov. 15, 1996 now abandoned.

BACKGROUND OF THE INVENTION

1. Field of the Invention

This invention pertains generally to toothbrushes and, more particularly, to a toothbrush having a resilient bumper which prevents injury to the teeth and gums, and to a method of manufacturing the same.

2. Related Art

Heretofore, some toothbrushes have been provided with resilient elements for use in massaging the gums or for preventing injury to the teeth and/or gums from impact with the brush. One such device is shown, for example, in U.S. Pat. No. 5,325,560, where a relatively thin protective bumper of U-shaped cross-section is fitted over the outer edge of the brush.

U.S. Pat. No. 3,258,805 discloses a toothbrush having bristles encased in vulcanized rubber to avoid harsh grating of tooth enamel by the relatively stiff bristles.

U.S. Pat. No. 2,253,210 shows toothbrushes which have resilient projecting elements for massaging the gums, and U.S. Pat. No. 2,144,408 shows a cushioned frame encircling the bristles of a toothbrush for massaging the gums.

U.S. Pat. No. 1,251,250 shows an attachment which fits over the head of a toothbrush and has rubber bristles positioned beside the regular bristles of the brush for use in massaging the gums.

U.S. Pat. No. 1,188,823 discloses a resilient cover which fits over the head of a toothbrush and has a skirt which encircles the bristles for massaging the gums and protecting them from being bruised and injured by the hard portion of the brush.

OBJECTS AND SUMMARY OF THE INVENTION

It is in general an object of the invention to provide a new an improved toothbrush which has a protective bumper for preventing injury to the teeth and gums of a person using the brush, and to a method of manufacturing the same.

Another object of the invention is to provide a toothbrush and method of the above character which overcome the limitations and disadvantages of the prior art.

These and other objects are achieved in accordance with the invention by forming a toothbrush with an elongated handle, a head joined at its base to the handle and having a peripheral side edge which extends around the head from one side of the handle to another, a plurality of bristles extending from a face of the head bounded by the side edge, a peripheral groove extending along the side edge with opposite ends of the groove adjacent to the two sides of the handle, and a protective resilient bumper which is disposed in the groove and projects laterally from the side edge to protect the teeth and gums of a person using the toothbrush from impact with the head. In some disclosed embodiments, a tunnel extends through the base of the head between the two ends of the groove, and the bumper consists a ring of resilient material which passes through the tunnel. In others, the bumper is molded in place and thereby bonded integrally and permanently to the head.

BRIEF DESCRIPTION OF THE DRAWINGS

FIG. 1 is fragmentary side elevational view of one embodiment of a toothbrush according to the invention.

FIG. 2 is an exploded view of the embodiment of FIG. 1.

FIG. 3 is a fragmentary rear elevational view of the embodiment of FIG. 1.

FIG. 4 is a cross-sectional view taken along line 4—4 in FIG. 3.

FIG. 5 is a cross-sectional view taken along line 5—5 in FIG. 3.

FIG. 6 is fragmentary side elevational view of another embodiment of a toothbrush according to the invention.

FIG. 7 is a view similar to FIG. 6 with the protective bumper removed.

FIG. 8 is an enlarged fragmentary vertical sectional view of the embodiment of FIG. 6.

FIG. 9 is a fragmentary rear elevational view of the embodiment of FIG. 6.

FIG. 10 is a cross-sectional view taken along line 10—10 in FIG. 9.

FIG. 11 is a cross-sectional view taken along line 11—11 in FIG. 9.

FIG. 12 is fragmentary side elevational view of another embodiment of a toothbrush according to the invention.

FIG. 13 is a view similar to FIG. 12 with the protective bumper removed.

FIG. 14 is an enlarged fragmentary vertical sectional view of the embodiment of FIG. 12.

FIG. 15 is a fragmentary rear elevational view of the embodiment of FIG. 12.

FIG. 16 is a cross-sectional view taken along line 16—16 in FIG. 15.

FIG. 17 is a cross-sectional view taken along line 17—17 in FIG. 15.

DETAILED DESCRIPTION

As illustrated in FIGS. 1–5, the toothbrush has an elongated handle 16 and a head 17 which extends from one end of the handle. The handle and head are fabricated of a relatively rigid material such as a hard plastic. A plurality of bristles 18 extend from the front face of the head, and a resilient O-ring 19 projects laterally from the side edge 21 of the head to protect the teeth and gums of a person using the brush from injury due to impact with the relatively hard head. The O-ring is fabricated of a material such a synthetic rubber (e.g., Viton®) with a durometer rating, or hardness, on the order of 50.

The O-ring is mounted in a peripheral groove 22 which extends along the side edge of the head, with the ends of the groove 23, 24 adjacent to the sides of the handle 26, 27 at the base of the head. The O-ring also passes through a tunnel 28 of circular cross-section which extends through the base of the head between the ends of the groove and forms a continuous path with the groove. As best seen in FIG. 3, the head has a generally rectangular shape, with a semicircular outer end, and the tunnel extends in an arcuate direction at the base end of the head, with the O-ring extending along a semicircular path at that end as well.

Head 17 is formed in two parts—a front section 31 which is formed integrally with handle 16 and a retaining plate 32 which is mounted on the back side of the front section. Section 31 is of lesser thickness than the handle, and the two parts together have an overall thickness equal to that of the handle.

Front section 31 has a front face 33 from which the bristles extend and a boss 34 which extends rearwardly behind the face. The boss has a rounded rectangular body 36 with straight sides and semicircular ends 37, 38. O-ring groove 22 extends peripherally about the boss, and has a generally semicircular cross-section. A rearwardly facing, generally planar step 41 is formed between the outer end of the handle and the boss, with the surface of the step being coplanar with the centerline of groove 22. The upper edge of the step has a curvature corresponding to the curved end of the boss, and a quarter round groove 42 extends along the upper edge and connects with groove 22 to form a three-quarters round section of groove at the lower end of the boss. In the embodiment illustrated, the thickness of the step is approximately one-half the thickness of the handle.

Retaining plate 32 has a relatively thin main section 43 positioned to the rear of boss 34 and a thicker section 44 behind step 41. The upper edge 45 of section 44 is curved to match the semicircular curvature of the lower end 38 of the boss, and has a quarter round groove 46 formed in it. That groove aligns with the three-quarters round section of groove at the lower edge of the boss to form tunnel 28. The rear surface 47 of the plate is generally planar and is aligned with the rear surface 48 of the handle to form a smooth continuous body.

The outer edges 49, 50 of front face 33 and rear plate 32 are rounded to give the side edge of the head a generally semicircular curvature, which blends well with the O-ring projecting from it. The O-ring typically has a cross-sectional diameter on the order of 3⁄32 inch, and when installed in the semicircular groove projects a distance on the order of at least 3⁄64 inch beyond the side edge of the head.

The toothbrush is assembled by placing O-ring in the groove on the boss. The rear plate is then permanently affixed to the front section of the head by cementing or otherwise bonding it in place. As noted above, the plate extends across the portion of the groove in the lower end of the boss, completing the tunnel and preventing the O-ring from becoming dislodged from the head.

In use, the resilient O-ring projects laterally from the side edge of the head and protects the teeth and gums from injury due to impact with the relatively hard head of the brush. The O-ring can be removed from the groove for cleaning without danger of being lost since it is permanently linked to the head by the tunnel. With the ring anchored in this manner, there is no danger that it will become dislodged or swallowed when the brush is in use.

In the embodiment shown in FIGS. 6–11, the toothbrush has an elongated handle 51 with a head 52 extending from the outer end of the handle. In this embodiment, the handle and the head are formed a unitary structure of a relatively rigid material such as a hard plastic. A plurality of bristles 53 extend from the front face 54 of the head, and a ring of resilient material 56 projects laterally from the side edge 57 of the head to protect the teeth and gums from injury due to impact with the relatively hard head.

The ring is mounted in a peripheral groove 58 which extends along the side edge of the head, with the ends of the groove 59, 61 adjacent to the sides of the handle 62, 63 at the base of the head. The ring also passes through a tunnel 64 of semicircular cross-section which extends in an arcuate direction through the base of the head between the ends of the groove.

Ring 56 is formed of an elastomeric material such as Viton® which is molded in place on the head of the brush, filling groove 58 and tunnel 64 and projecting from the side edge 57 in the form of a semicircular bead 65. Groove 58 has a dovetail shape, with a flat bottom wall 66 and inwardly and outwardly inclined side walls 67 which lock the ring in place on the head. The groove preferably has a depth on the order of at least 3⁄64 inch, and the semicircular bead has a diameter on the order of at least 3⁄32 inch, giving the ring an overall thickness of at least 3⁄32 inch from the bottom of the groove to the outer edge of the bead. With a durometer rating, or hardness, on the order of 50, this amount of cushioning has been found to provide good protection against injury to the teeth and gums due to impact with the head of the brush.

As in the embodiment of FIGS. 1–5, the side edge 57 of the head of the toothbrush has a generally semicircular curvature which blends well with the ring projecting from it. With the dovetail groove and the tunnel, there is no danger that the ring will become dislodged or swallowed.

In the embodiment shown in FIGS. 12–17, the toothbrush has an elongated handle 71 with a head 72 extending from the outer end of the handle. As in the embodiment of FIGS. 6–11, the handle and the head are formed a unitary structure of a relatively rigid material such as a hard plastic. A plurality of bristles 73 extend from the front face 74 of the head, and a resilient bumper 76 projects laterally from the side edge 77 of the head to protect the teeth and gums from injury due to impact with the relatively hard head.

The bumper is mounted in a peripheral groove 78 which extends along the side edge of the head, with the ends of the groove 79, 81 being conically tapered near the sides of the handle 82, 83 at the base of the head.

Bumper 76 is formed of an elastomeric material such as Viton® which is molded in place on the head of the brush, filling groove 78 and projecting from the side edge 77 in the form of a semicircular bead 85. Groove 78 is semicircular in cross-section, and preferably has a diameter or depth on the order of at least 3⁄64 inch. The bumper is circular in cross-section and preferably has a diameter of at least 3⁄32 inch so that it projects from the edge of the head by a distance of at least 3⁄64 inch. With a durometer rating, or hardness, on the order of 50, a bumper having these dimensions has been found to provide good protection against injury to the teeth and gums due to impact with the head of the brush.

In one presently preferred embodiment, handle 71 and head 72 are fabricated of a relatively hard thermoplastic material, and bumper 76 is fabricated of a thermoplastic elastomer such as an Engage polyolefin elastomer manufactured by DuPont Dow Elastomers as an 8180 grade material having a Shore A hardness, or durometer reading, of 66. The elastomer is injected into a mold in hot liquid form under pressure to fill groove 78 and the surrounding cavity to form the bumper. When the hot elastomer is injected, some melting of the thermoplastic material which forms the head occurs along the groove, and the two thermoplastic materials flow together, forming a strong, permanent bond between the bumper and the head, whereby the bumper is fused to the head.

Many toothbrushes are currently being manufactured with handles covered with an injection molded elastomer, such as an Engage polyolefin, and a protective bumper according to the invention can be added to the heads of these brushes during the molding process with no increase in the processing time and only minor alteration of the molds or tooling.

As in the embodiments of FIGS. 1–5 and 6–11, the side edge 77 of the head of the toothbrush has a generally semicircular curvature which blends well with the ring projecting from it. With the bumper bonded integrally to the head, there is no danger that it will become dislodged or swallowed.

In each of the disclosed embodiments, the manner in which the brush is constructed and the protective ring is installed represents a significant improvement over prior art devices with relatively thin cushions or O-rings which can become dislodged and lost or swallowed. This structure also enables the brush to be manufactured economically and easily.

It is apparent from the foregoing that a new and improved toothbrush and method of manufacture have been provided. While only certain presently preferred embodiments have been described in detail, as will be apparent to those familiar with the art, certain changes and modifications can be made without departing from the scope of the invention as defined by the following claims.

What is claimed is:

1. A toothbrush having an elongated handle, a head extending from the handle, a peripheral side edge which extends around the head from one side of the handle to another, a face bounded by the side edge, a plurality of bristles extending from the face, a peripheral groove extending along the side edge with opposite ends of the groove adjacent to the sides of the handle, and a body of resilient material which is molded in place in the groove and thereby bonded directly to the head with a portion of the resilient material projecting laterally from the side edge to protect the teeth and gums of a person using the toothbrush from impact with the head.

2. The toothbrush of claim 1 wherein the groove is generally semicircular in cross-section, and the body of resilient material is generally circular in cross-section.

3. The toothbrush of claim 1 wherein the body of resilient material has a cross-sectional dimension of at least 3/32 inch.

4. A toothbrush made by the steps of forming an elongated handle with a head having a peripheral groove which extends around a side edge of the head from one side of the handle to another, and injecting a body of elastomeric material into the groove in hot liquid form to form a protective bumper which is bonded directly to the head with a portion of the elastomeric material projecting laterally from the side edge of the head to protect the teeth and gums of a person using the toothbrush from impact with the head.

5. A toothbrush having an elongated handle, a head extending from the handle, a peripheral side edge which extends around the head from one side of the handle to another, a face bounded by the side edge, a plurality of bristles extending from the face, a peripheral groove extending along the side edge with opposite ends of the groove adjacent to the sides of the handle, and a body of resilient material which is disposed in the groove and bonded to the head with a portion of the resilient material projecting laterally from the side edge to protect the teeth and gums of a person using the toothbrush from impact with the head, with the ends of the groove and the body of resilient material being conically tapered.

6. A toothbrush having an elongated handle, a head extending from the handle, a peripheral side edge which extends around the head from one side of the handle to another, a face bounded by the side edge, a plurality of bristles extending from the face, a peripheral groove extending along the side edge with opposite ends of the groove adjacent to the sides of the handle, tunnel openings extending into the head from each end of the groove, and a body of resilient material which is disposed in the groove, extends into the tunnel openings and projects laterally from the side edge to protect the teeth and gums of a person using the toothbrush from impact with the head.

7. A toothbrush having an elongated handle, a head extending from the handle, a peripheral side edge which extends around the head from one side of the handle to another, a face bounded by the side edge, a plurality of bristles extending from the face, a peripheral groove extending along the side edge with opposite ends of the groove adjacent to the sides of the handle, a tunnel extending through the head between the ends of the groove, and a ring of resilient material which is disposed in the groove, passes through the tunnel and projects laterally from the side edge to protect the teeth and gums of a person using the toothbrush from impact with the head.

8. The toothbrush of claim 7 wherein the tunnel extends through the head in an arcuate direction and forms a continuous path with the groove.

9. The toothbrush of claim 7 wherein the ring is an O-ring, and the head is formed in two parts which are joined together at the tunnel.

10. The toothbrush of claim 7 wherein the ring is molded into the groove and tunnel.

11. The toothbrush of claim 10 wherein the groove has a dovetail shape in cross-section.

12. A toothbrush having an elongated handle, a head extending from the handle, a peripheral side edge which extends around the head from one side of the handle to another, a face bounded by the side edge, a plurality of bristles extending from the face, a peripheral groove extending along the side edge with opposite ends of the groove adjacent to the sides of the handle, a tunnel extending through the head between the ends of the groove, and a ring of resilient material molded into the groove and the tunnel to form a protective bumper which projects laterally from the side edge and prevents the head from impacting against the teeth and gums of a person using the toothbrush.

13. The toothbrush of claim 12 wherein the tunnel extends through the head in an arcuate direction and forms a continuous path with the groove.

14. The toothbrush of claim 12 wherein the bumper projects laterally from the side edge of the head by a distance on the order of at least 3/64 inch.

15. The toothbrush of claim 12 wherein the groove has a dovetail shape in cross-section.

16. The toothbrush of claim 12 wherein the tunnel has a semicircular shape in cross-section.

17. A toothbrush having an elongated body with a handle portion and a head portion, the head portion extending from one end of the handle portion and being of lesser thickness than the handle portion, a plurality of bristles extending from a front face of the head portion, a boss extending rearwardly of the front face, a peripheral groove in a side edge of the boss, a resilient O-ring disposed in the groove, and a rear plate affixed to the head portion behind the boss and extending across a portion of the groove toward the handle portion to form a tunnel in which a portion of the O-ring is enclosed.

18. The toothbrush of claim 17 wherein the boss has generally parallel side edges and semicircular ends in which the groove is formed.

19. A toothbrush having an elongated handle, a head fabricated of a thermoplastic material at one end of the handle, the head having a peripheral side edge which extends around the head from one side of the handle to another and a face bounded by the side edge, a plurality of bristles extending from the face of the head, a peripheral groove in the side edge of the head, and a protective bumper of thermoplastic elastomer material mounted in the groove and fused to the head with a portion of the elastomer material projecting laterally from the side edge of the head to protect the teeth and gums of a person using the toothbrush from impact with the head.

* * * * *